United States Patent [19]

Birch et al.

[11] Patent Number: 4,830,536

[45] Date of Patent: May 16, 1989

[54] METHOD AND APPARATUS FOR TUNNEL LINING

[75] Inventors: Robert M. Birch; Warren E. Brown, both of Youngstown, Ohio

[73] Assignee: Commercial Shearing, Inc., Youngstown, Ohio

[21] Appl. No.: 634,122

[22] Filed: Jul. 25, 1984

Related U.S. Application Data

[63] Continuation of Ser. No. 291,024, Aug. 7, 1981, abandoned.

[51] Int. Cl.[4] ..... E21D 11/00

[52] U.S. Cl. ..... 405/153; 405/261; 411/54; 411/60; 411/82; 411/521

[58] Field of Search ..... 405/146, 151–153, 405/261; 411/82, 258, 512, 521, 525, 528, 54, 60; 52/309.16, 309.17, 583, 587; 24/216, 217 R, 630, 682, 683

[56] References Cited

U.S. PATENT DOCUMENTS

| | | | |
|---|---|---|---|
| 935,376 | 9/1909 | Lennon | 405/153 X |
| 1,378,158 | 5/1921 | West et al. | 405/151 |
| 1,969,810 | 8/1934 | McAlpine | 405/151 |
| 1,982,308 | 11/1934 | Kahn et al. | 405/151 |
| 2,712,262 | 7/1955 | Knohl | 411/521 |
| 3,131,514 | 5/1964 | Siek | 52/309.16 X |
| 3,155,808 | 11/1964 | Wiley | 24/217 X |
| 3,757,389 | 9/1973 | Wiland | 24/217 X |
| 3,796,124 | 3/1974 | Crosa | 411/521 |
| 3,916,756 | 11/1975 | Yoda | 24/217 R |
| 4,023,373 | 5/1977 | Hipkins | 405/261 |
| 4,104,885 | 8/1978 | Thomas | 405/153 |
| 4,122,681 | 10/1978 | Vass et al. | 405/261 |
| 4,305,683 | 12/1981 | Wagner et al. | 405/151 X |
| 4,477,204 | 10/1984 | Rohde et al. | 405/151 X |

FOREIGN PATENT DOCUMENTS

| | | | |
|---|---|---|---|
| 794557 | 9/1968 | Canada . | |
| 1811608 | 6/1970 | Fed. Rep. of Germany . | |
| 2238792 | 3/1973 | Fed. Rep. of Germany . | |
| 2405883 | 3/1976 | Fed. Rep. of Germany . | |
| 2457427 | 6/1976 | Fed. Rep. of Germany . | |
| 2741092 | 3/1979 | Fed. Rep. of Germany . | |
| 2928229 | 2/1981 | Fed. Rep. of Germany . | |
| 2126661 | 10/1972 | France . | |
| 541822 | 12/1941 | United Kingdom | 405/153 |
| 1034303 | 6/1966 | United Kingdom | 405/153 |

OTHER PUBLICATIONS

"Berg-und Huttenmanische Monatshefte.", 10/1980, p. 558.

Engineering and Mining Journal. 6/1981, pp. 116, 117.

"Brucke und Strasse." 10/1961, pp. 400, 401.

*Primary Examiner*—Hoang C. Dang

*Attorney, Agent, or Firm*—Buchanan Ingersoll

[57] ABSTRACT

A method and apparatus for tunnel lining is provided made up of arcuate liner segments having a formed body with two end walls and two substantially parallel sidewalls, at least two pins extending from one sidewall intermediate its length in the median plane of the body and transverse to said sidewall, a like number of openings in the other sidewall each adapted to receive one of said at least two pins from two adjacent interfitting segments and locking means in said opening permitting insertion of said at least two pins in said openings of adjacent segments and lockingly engaging the same against removal and urging said two adjacent fittings into tight end to end engagement.

16 Claims, 4 Drawing Sheets

Fig. 12.
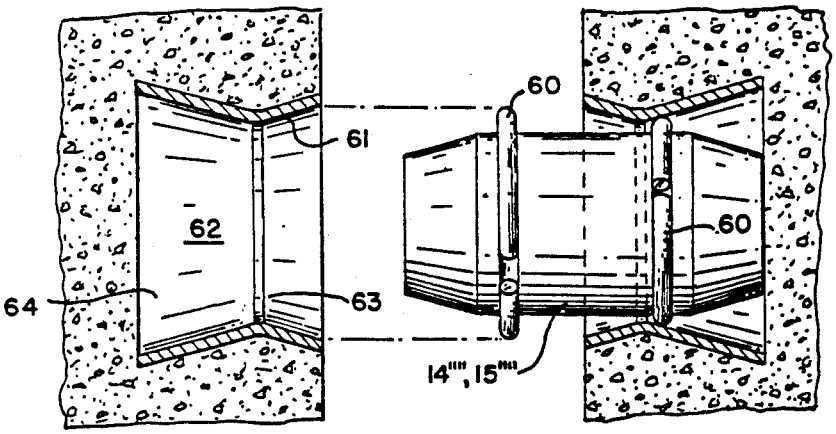
Fig. 13.
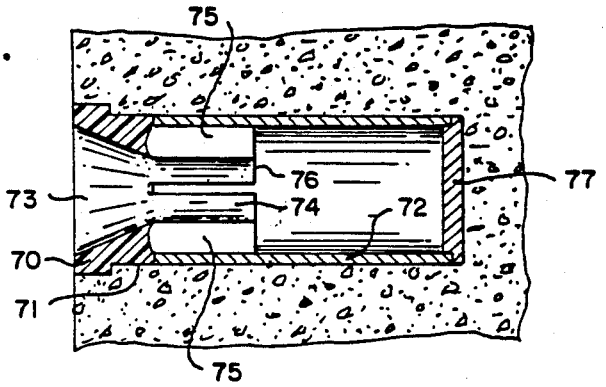
Fig. 14.
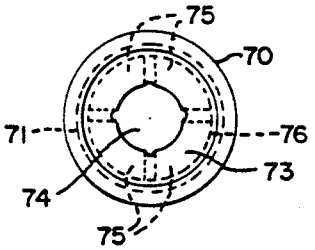
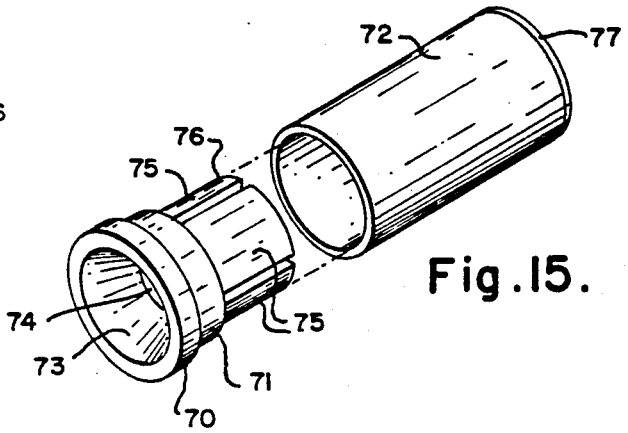
Fig. 15.

METHOD AND APPARATUS FOR TUNNEL LINING

This application is a continuation of my copending application Ser. No. 291,024 filed Aug. 7, 1981, now abandoned.

This invention relates to methods and apparatus for tunnel lining and particularly to methods and apparatus for facilitating the erecting and sealing of tunnel linings.

Tunnel liners for large diameter bores through the earth for subways, water ways, sewage systems and the like are well known and of great variety. Basically tunnel liners are made up of a plurality of arcuate segments which are put together to form a cylindrical section of an elongate cylindrical tunnel structure. In general they have been made either of metal or concrete and fastened together both longitudinally and circumferentially by bolts. The use of bolts as fasteners require that the linear segments have internal flanges, recesses or pockets on the inner surface in order to permit access to the fasteners so as to apply the fastening means, e.g. nuts. Such flanges, recesses or pockets defeat the desired end of having a smooth inner bore and require that the inner bore be finished by filling these recesses with concrete or the like.

It has heretofore been proposed to use pins or projections on the side edges of tunnel liner segments to align and hold the segments as the segments are installed. Unfortunately, however, such devices were not capable of firmly fastening the adjacent segments together so as to prevent their separation either circumferentially or axially of the tunnel. Thus a tunnel lined with such segments could separate at the joints and required some external fastening means to hold the segments in place both in the individual ring sections and in the length of the tunnel.

We have invented a tunnel liner segment, tunnel liner and method of tunnel lining which eliminates all of these problems of this prior art. The tunnel liner segments of our invention may be quickly assembled into a complete tunnel liner which is sealed and will not separate under normal conditions. It does not require the presence of fastening flanges, recesses or pockets as did prior art devices. It is readily constructed, easily assembled and tight fitting.

We provide a tunnel liner made up of a plurality of arcuate segments having two end walls and two spaced generally parallel sidewalls, at least two pins on one sidewall extending therefrom in the median plane of the segment, a like number of openings in the other sidewall adapted to receive like pins from two adjacent segments and locking means in each said opening permitting the pins to be inserted in the opening but lockingly engaging them against removal while urging said two segments in end to end engagement. Preferably the locking means is a one way friction locking means such as one or more Timmerman clips or the like in the opening which permit the pin to be inserted but engage it to prevent removal. The locking means may also be a split pin or hollow pipe which is expanded in an enlarged position of the opening by an expansion device, such as a wedge in the opening. Another alternative locking device is a resin pack inserted in the opening and punctured and activated by the insertion of the pin to harden around the pin in the opening to fix it against removal. The final and perhaps most useful embodiment consists of a cylindrical plastic sleeve having an enlarged head with a frusto conical opening, a plurality of lengthwise slits in the reduced diameter body following said opening and a metal shell surrounding and engaging said head and spaced from said reduced diameter body. On inserting a pin into the frusto conical opening it is guided between the slit portions of the reduced diameter body which frictionally engage the same while permitting some axial misalignment. Finally a combination of these locking means, such as for example one of the mechanical fastening means and the resin pack, can be especially effective. Preferably all segments in each ring except two are of parallelogram shape and the remaining two are trapezoidal in shape for ease in completing the ring within a tunnel. Either of both sidewall and endwalls may have mating tongues and grooves.

In the foregoing general description we have set out certain objects, purposes and advantages of our invention. Other objects, purposes and advantages of the invention will be apparent from a consideration of the following description and the accompanying drawings in which:

FIG. 12 is an enlarged fragmentary section of another embodiment of liner segment connector according to our invention;

FIG. 13 is an enlarged fragmentary section of a fifth and preferred embodiment of liner segment connector according to our invention;

FIG. 14 is an end elevational view of the connector of FIG. 13; and

FIG. 15 is an exploded isometric view of the connector of FIG. 13.

Figure 2:
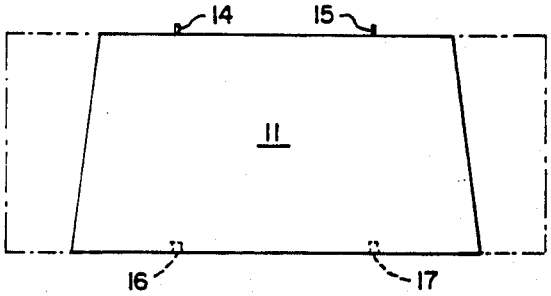
FIG. 2 is a top plan view of the tunnel liner section of FIG. 1.
Figure 3:
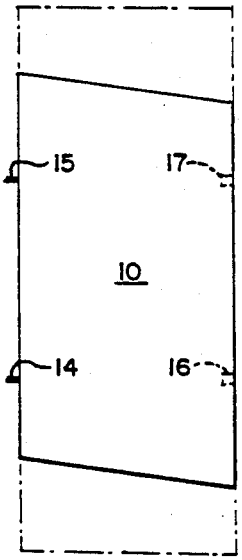
FIG. 3 is a side elevational view of the tunnel liner sections of FIG. 1 from the left of FIG. 1.
Figure 1:
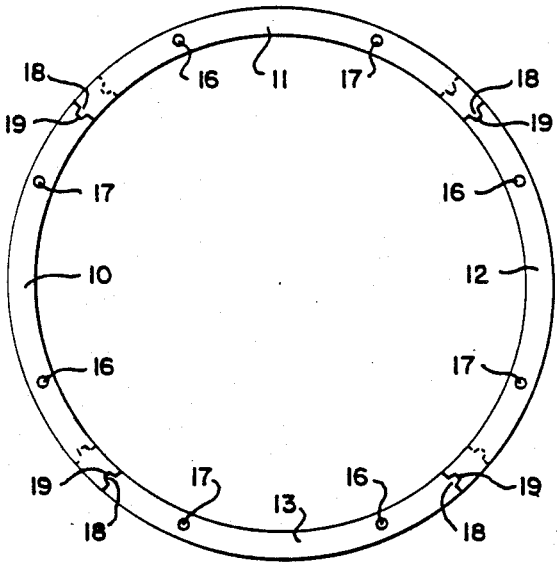
FIG. 1 is an end elevational view of a tunnel liner section made up of four segments according to our invention.
Figure 4:
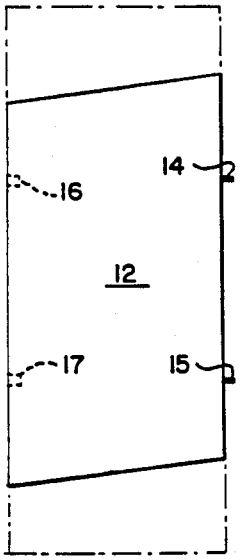
FIG. 4 is a side elevational view of the tunnel liner section of FIG. 1 from the right of FIG. 1.
Figure 5:
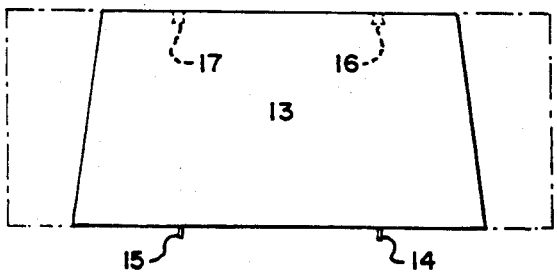
FIG. 5 is a bottom plan view of the tunnel liner of FIG. 1.
Figure 6:
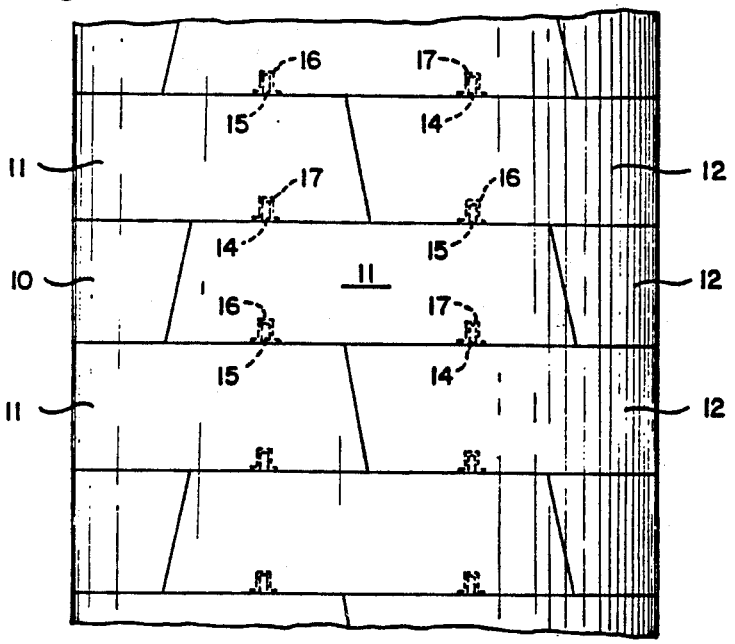
FIG. 6 is a fragmentary top plan view of a partly installed tunnel liner showing the staggered relationship of liner segments in a preferred practice.

Referring to the drawings we have illustrated in FIG. 1 a single section of tunnel liner made up of four liner segments 10, 11, 12 and 13, two of which, 10 and 12, are of parallelogram form and two of which 11 and 13, are of isosceles trapezoidal form. One side edge of each segment is provided with two pins 14 and 15 spaced apart transversely of the edge at is median plane. The other side edge of each segment is provided with a pair of identically spaced sockets 16 and 17. These are preferably spaced apart at 45° in the segment and at 45° between segments so that the segments of different sections can be staggered as shown in FIG. 6. Preferably the segment ends are provided with interfitting tongues and grooves 18 and 19.

Figure 7:
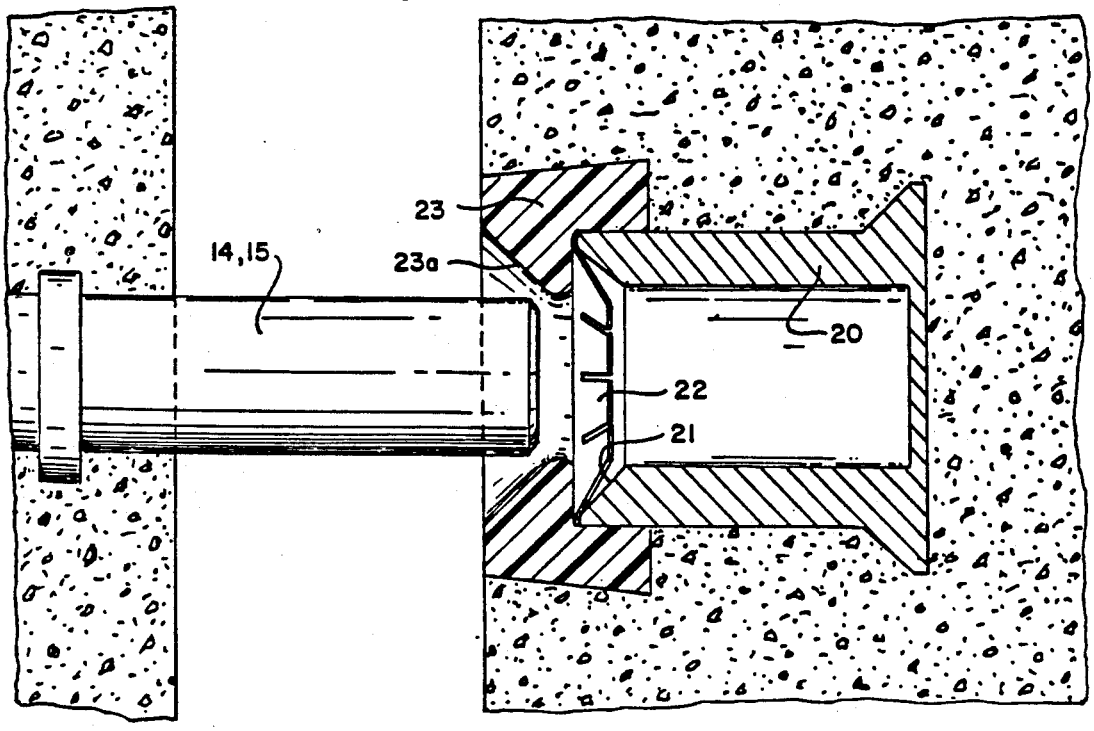
FIG. 7 is an enlarged fragmentary section of two side by side liner segments showing a pin and Timmerman friction grip coupling arrangement for use in this invention.

The pins 14 and 15 may be solid pins as shown in FIG. 7 which are cast into the concrete of the liner segment at one end, leaving the other end extending from the sidewall of the segment. The sockets in such case are preferably made of an inner cylindrical receptacle 20 having a conical opening 21 carrying a Timmerman clip 22 or similar one-way friction grip device and an outer guide member 23 holding the Timmerman clip 22 and having a conical guide opening 23*a* to guide the pin 14–15 into and through the Timmerman clip. The exterior of the guide member 23 may be conical in shape as shown or be provided with an external flange or similar device for holding it in the concrete cast around it.

The pin 19 is inserted through guide opening 23*a*, through the opening in Timmerman clip 22 into the receptacle opening until the two segments abut. The Timmerman clip 22 engages the exterior pin 19 to prevent its removal and this locks the two adjacent segments tightly together.

Figure 8:
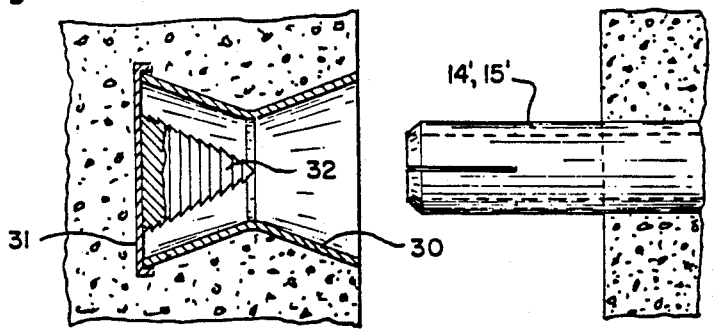
FIG. 8 is an enlarged fragmentary section of two side by side liner segments showing a split hollow pin and expander for use in this invention.

In the embodiment illustrated in FIG. 8, the pins 14' and 15' are in the form of hollow split pipes which are preferably filled with plastic resin. The socket is preferably of double frusto conical or hour-glass shape 30 having an inner cap 31 with a central conical expander 32. The socket 30 and cap 31 are cast into the concrete segment. The pipe pin is cast into an adjacent segment and the pipe is forced into the socket 30 onto toothed expander 32 causing the split pipe end to be expanded within the socket 30 around toothed expander 32 and forcing the plastic resin to expand within the socket.

Figure 9:
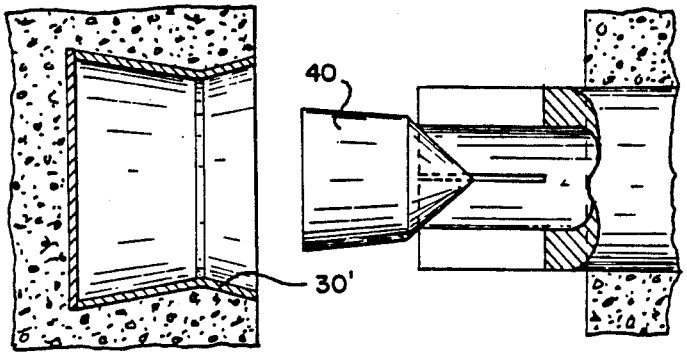
FIG. 9 is a second embodiment of split hollow pin arrangement for use in this invention.

In FIG. 9 we have illustrated another form of expanded pipe end structure similar to that of FIG. 8, with a somewhat different form of expander device 40, which may be inserted in the end of the hollow split pipe to expand the same when inserted in the socket 30'.

Figure 10:
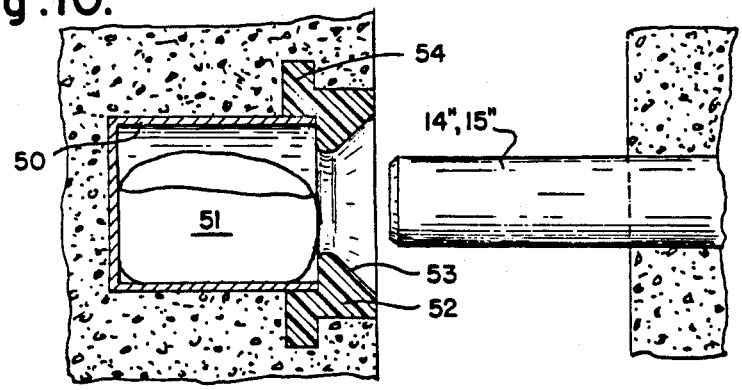
FIG. 10 is an enlarged fragmentary section of two side by side liner segments showing a plastic, puncturable pouch and pin arrangement according to this invention.

In FIG. 10 we have illustrated a device in which pins 14'' and 15'' enter a socket made up of an inner cylinder hollow cup 50 containing a two part plastic bag 51 having plastic resin and hardener in separate portions thereof. A guide member 52 having a frusto conical opening 53 acts to guide pins 14'' and 15'' into their respective receptacle 50 to puncture the resin and hardener bags and cause them to intermix and be forced around the periphery of the pin in the socket so as to set up and hold the same in place. An annular flange 54 on the guide member holds it against removal from the cast concrete segment.

Figure 11:
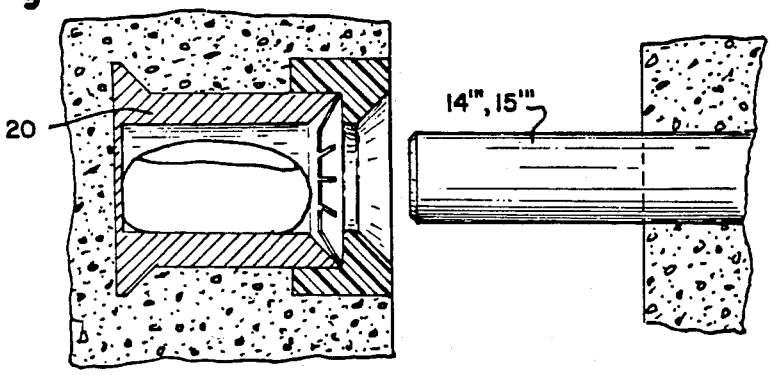
FIG. 11 is an enlarged fragmentary section of a combination of the structures of FIGS. 7 and 9.

FIG. 11 is essentially the same structure as shown in FIG. 7 except that a plastic two part bag containing resin and hardener, as in FIG. 10, is inserted in receptacle 20 to be punctured by inserting pin 14''' or 15''' therein. This causes the resin and hardener to be intermixed and forced around the pin and socket interior. This provides both additional holding power and protection against corosion of the metal parts.

The form illustrated in FIG. 12 provides pins 14'''' and 15'''' having a resilient locking ring 60 intermediate the ends of the portion extending out of the segment. The locking ring 60 is compressed by the frusto conical guide opening 61 in socket 62 permitting the pin to be inserted through the opening 63 into the inner receptacle portion 64 of the socket where ring 60 expands to a diameter, intermediate the original and the compressed diameters preventing its removal and urging the pin into socket 62.

The form of liner segment connector illustrated in FIGS. 13, 14 and 15 provides an elongate cylindrical plastic (e.g. ABS) locking member having a cylindrical head 70 with a reduced shoulder 71 and a second reduced portion formed by reduced body portion 76 engaging and connected in a metal protective cylinder 72. The head 70 has a frusto conical opening 73 leading to a cylindrical passage 74 between elongate legs 75 formed by slitting a reduced body portion 76 extending axially from head 70. When a pin 14''''' or 15''''' is inserted into frusto conical opening 73 it is guided into passage 74 expanding the plastic around it which in turn frictionally engages the pin preventing its removal except with the use of substantial force. Preferably the end of metal cylinder 72 opposite head 70 is closed by a cap 77 which may be plastic or metal.

In the foregoing specification we have set out certain preferred practices and embodiments of our invention, however, it will be understood that this invention may be otherwise embodied within the scope of the following claims.

We claim:

1. A tunnel liner segment comprising a formed body having two end walls and two substantially parallel sidewalls, at least two pins extending from one sidewall intermediate its length in the median plane of the body and transverse to said sidewall, a like number of openings in the other sidewall each adapted to receive one of said at least two pins from two adjacent interfitting segments, friction locking means in each said opening permitting insertion of said at least two pins in said openings of adjacent segments and lockingly engaging the same against removal and urging said two adjacent segments into tight end to end engagement and a fracturable container of hardenable fluid plastic resin components in each said opening in an amount sufficient to fill completely the opening when a pin is inserted therein whereby when said pins are inserted in said openings, the friction locking member immediately engages said pin against removal and the fracturable container is fractured by said pin releasing and mixing the hardenable plastic resin components within said opening and around the pin and friction locking member to harden in situ therearound to hold the pin against removal and to seal the pin in said opening.

2. A tunnel liner segment as claimed in claim 1 wherein the friction locking member is a Timmerman clip fixed against removal in an annular recess intermediate the ends of said opening.

3. A tunnel liner segment as claimed in claim 1 wherein said opening includes an inner cylindrical receptacle means and a outer guide means, at least one annular groove between the receptacle means and guide means and a Timmerman clip fixed in said at least one groove.

4. A tunnel liner segment as claimed in claim 1 wherein the pin is hollow and split on the end extending from the sidewall and the opening includes an annular restriction intermediate the ends of the opening and a conical expander member in the interior of the opening acting to expand the split end of the pin inside the annular restriction to prevent its removal from the opening.

5. A tunnel liner segment as claimed in claim 1 wherein the locking means is an elongate plastic cylinder having an axial passage, a frusto conical guide opening at one end and a plurality of slits at the other end forming axial gripping fingers.

6. A tunnel liner segment as claimed in claim 1 or 2 or 3 or 4 or 5 wherein the liner segment is made of reinforced concrete.

7. A tunnel liner segment as claimed in claim 1 wherein the liner segment is made of reinforced concrete.

8. A tunnel liner segment as claimed in claim 1 or 2 or 3 or 4 or 5 wherein one sidewall is provided with two pins and the other sidewall is provided with two openings.

9. A tunnel liner segment as claimed in claim 1 or 2 or 3 or 4 or 5 wherein one end wall is provided with a tongue and the other end wall with a like contoured groove.

10. A tunnel lining ring made up of a combination of parallelogram and trapezoidal shaped liner segments, each segment having two end walls and two parallel sidewalls, at least one pin extending from one sidewall intermediate its length in the median plane of the segment and transverse to said sidewall, a like number of openings in the other sidewall adapted to receive said at least one pin from an adjacent interfitting segment, friction locking means in said opening permitting insertion of said at least one pin in said opening and lockingly engaging the same against removal, and a fracturable container of hardenable fluid plastic resin components in each said opening in an amount sufficient to fill completely the opening when a pin is inserted therein whereby when said pins are inserted in said openings, the friction locking member immediately engages said pin against removal and the fracturable container is fractured by said pin releasing and mixing the hardenable plastic resin components within said opening and around the pin and friction locking member to harden in situ therearound to hold the pin against the removal and to seal the pin in said opening.

11. A tunnel liner ring as claimed in claim 10 wherein the end walls have interfitting tongued and groove portions.

12. A tunnel liner ring as claimed in claim 10 or 11 wherein one side wall of each segment has at least two transverse pin extending therefrom on the median plane and the other side has a like number of mating openings on the median plane, and locking means in each opening permitting insertion of a pin from a next adjacent segment therein and lockingly engaging the same against removal.

13. A tunnel liner ring as claimed in claim 10 wherein the friction locking member is a Timmerman clip held in an annular recess in the opening.

14. A tunnel liner ring as claimed in claim 10 or 11 wherein the pin is hollow and split on the end extending from the sidewall and the opening includes an annular restriction intermediate the ends of the opening and a conical expander member in the interior of the opening acting to expand the split end of the pin inside the annular restriction to prevent its removal from the opening.

15. A tunnel liner ring as claimed in claim 10 or 11 wherein the locking means is an elongate plastic cylinder having an axial passage, a frusto conical guide opening at one end and a plurality of slits at the other end forming axial gripping fingers.

16. A tunnel liner ring as claimed in claim 10 or 11 wherein the locking means is an elongate plastic cylinder having an axial bore therethrough and split at one end to a point intermediate the length thereof, an enlarged head on the opposite end having a frusto conical guide opening terminating in said bore and an outer cylindrical shell spaced from said cylinder and fixed to said head.

* * * * *

UNITED STATES PATENT AND TRADEMARK OFFICE

CERTIFICATE OF CORRECTION

PATENT NO. : 4,830,536

DATED : May 16, 1989

INVENTOR(S) : ROBERT M. BIRCH, WARREN E. BROWN

It is certified that error appears in the above-identified patent and that said Letters Patent is hereby corrected as shown below:

Column 1, line 19, change "linear" to --liner--.

Signed and Sealed this

Thirtieth Day of January, 1990

*Attest:*

JEFFREY M. SAMUELS

*Attesting Officer*

*Acting Commissioner of Patents and Trademarks*